US010575582B2

(12) United States Patent
Szela

(10) Patent No.: US 10,575,582 B2
(45) Date of Patent: Mar. 3, 2020

(54) TRUNCATED HELMET

(71) Applicant: Bell Sports, Inc., Scotts Valley, CA (US)

(72) Inventor: Alexander J. Szela, Santa Cruz, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 22 days.

(21) Appl. No.: 15/973,510

(22) Filed: May 7, 2018

(65) Prior Publication Data

US 2018/0317588 A1 Nov. 8, 2018

Related U.S. Application Data

(60) Provisional application No. 62/503,200, filed on May 8, 2017.

(51) Int. Cl.

| | |
|---|---|
| ***A42B 3/04*** | (2006.01) |
| ***A42B 3/22*** | (2006.01) |
| ***A42B 3/28*** | (2006.01) |
| *A42B 3/12* | (2006.01) |
| *A42B 1/08* | (2006.01) |
| *A42B 3/06* | (2006.01) |

(52) U.S. Cl.

CPC ..... *A42B 3/0493* (2013.01); *A42B 3/227* (2013.01); *A42B 3/283* (2013.01); *A42B 1/08* (2013.01); *A42B 3/06* (2013.01); *A42B 3/066* (2013.01); *A42B 3/125* (2013.01)

(58) Field of Classification Search

CPC ..... A42B 3/0493; A42B 3/066; A42B 3/227; A42B 3/283; A42B 3/125; A42B 3/06; A42B 1/08

USPC ..... 2/410, 6.3

See application file for complete search history.

(56) References Cited

U.S. PATENT DOCUMENTS 4,434,514 A * 3/1984 Sundahl ..... A42B 3/281 2/171.3
4,622,700 A * 11/1986 Sundahl ..... A42B 3/0493 2/171.3

(Continued)

FOREIGN PATENT DOCUMENTS

| | | |
|---|---|---|
| CN | 2482825 | 3/2002 |
| CN | 201393593 | 2/2010 |

(Continued)

*Primary Examiner* — Khaled Annis
*Assistant Examiner* — Dakota Marin
(74) *Attorney, Agent, or Firm* — Amardeep S. Grewal; Gerard M. Donovan; Reed Smith LLP

(57) ABSTRACT

A helmet with an outer shell, an inner liner, a plurality of vents, and an occipital cliff is disclosed. The outer shell includes an outer surface made up of a first and second surface, the first and second surfaces joined by a drop-off running across the outer surface from a left side of the helmet to a right side of the helmet. A majority of the drop-off is closer to a coronal plane bisecting the helmet than it is to the rear of the helmet. The drop-off is contained within a posterior section of the helmet defined by the coronal plane. The first surface defines a top of the drop-off and the second surface defines a bottom of the drop-off, such that the drop-off has a height. The occipital cliff is located at the rear end of the helmet and is approximately perpendicular to the second surface proximate the drop-off.

20 Claims, 9 Drawing Sheets

(56) References Cited

U.S. PATENT DOCUMENTS 4,901,373 A * 2/1990 Broersma ..... A42B 3/066 2/421
4,903,350 A * 2/1990 Gentes ..... A42B 3/0493 2/421
5,337,421 A * 8/1994 Jeng ..... A42B 3/066 2/171.3
5,450,631 A * 9/1995 Egger ..... A42B 3/066 2/171.3
5,619,756 A * 4/1997 Garneau ..... A42B 3/066 2/411
6,055,675 A * 5/2000 Egger ..... A42B 3/066 2/171.3
6,170,084 B1 * 1/2001 Gordon ..... A42B 3/227 2/12
6,305,030 B1 * 10/2001 Brignone ..... A42B 3/0493 2/425
7,376,980 B2 * 5/2008 Bullock ..... A42B 3/066 2/421
7,475,434 B2 * 1/2009 Ambuske ..... A42B 3/06 2/425
7,698,750 B2 * 4/2010 Bullock ..... A42B 3/066 2/410
7,987,525 B2 * 8/2011 Summers ..... A42B 3/281 2/410
8,793,816 B2 * 8/2014 Emrich ..... A42B 3/18 2/410
9,357,810 B2 * 6/2016 Garneau ..... A42B 3/066
2013/0283508 A1 * 10/2013 Durham ..... A42B 3/227 2/422
2014/0298570 A1 * 10/2014 Cobb ..... A42B 3/0493 2/410
2015/0250248 A1 * 9/2015 Jacobsen ..... A42B 3/12 2/421
2015/0250255 A1 * 9/2015 Ellison ..... A42B 3/326 2/425
2016/0366968 A1 * 12/2016 Kass ..... A42B 3/0493

FOREIGN PATENT DOCUMENTS

CN 206006093 3/2017
JP 2015166260 9/2015

* cited by examiner

TRUNCATED HELMET

RELATED APPLICATIONS

This application claims the benefit of U.S. provisional patent application 62/503,200, filed May 8, 2017 titled "Truncated Helmet," the entirety of the disclosure of which is hereby incorporated by this reference.

TECHNICAL FIELD

Aspects of this document relate generally to aerodynamic helmets.

BACKGROUND

Aerodynamics can play an important role in cycling events such as races and time trials. At race speeds, aerodynamic drag may account for up to 90% of the total resistance. A significant portion of the energy expended by a racer is used to overcome this drag, and efforts have been made to reduce drag caused by the rider's gear as well as the bike itself.

Previous efforts to reduce the drag caused by air moving over and around a riders head have resulted in a time trial (TT) helmets that are much larger than other types of helmets. Conventional TT helmets often have teardrop shapes, with elongated, tapering tails to facilitate the orderly flow of air over the helmet and rider while minimizing drag. However, this reduction in drag often comes at the cost of increased weight, discomfort, and unwieldiness. Furthermore, the long tail of conventional TT helmets may become an aerodynamic liability when the wearer's head is turned or when there is a crosswind. Additionally, the use of conventional TT helmets is sometimes restricted; for example, in some stage races, conventional TT helmets are prohibited, in part due to the danger they pose to other riders.

SUMMARY

According to one aspect, a helmet may comprise an anterior section and a posterior section defined by a coronal plane that bisects the helmet into sections having equal longitudinal length, the posterior section comprising a rear end of the helmet distal to the anterior section, an outer shell having an outer surface and an inner surface, the outer surface may comprise a first surface and a second surface, the first and second surfaces joined by a drop-off running across the outer surface from a left side of the helmet to a right side of the helmet and contained within the posterior section of the helmet, a majority of a length of the drop-off being closer to the coronal plane than to the rear end of the helmet, wherein the first surface defines a top of the drop-off and the second surface defines a bottom of the drop-off, and wherein along the entire drop-off, the bottom of the drop-off is closer to a central longitudinal axis of the helmet than the top of the drop-off such that the drop-off has a height, and at least three chines extending forward from the drop off along the first surface, an occipital cliff located at the rear end of the helmet and approximately perpendicular to the second surface proximate the drop-off, a plurality of vents comprising at least one intake vent in the anterior section of the helmet and at least one output vent in the posterior section of the helmet, the plurality of vents providing fluid communication between outside the helmet and inside the helmet, and an inner liner having an outer surface coupled to the inner surface of the outer shell and an inner surface comprising a plurality of interior channels connecting each of the at least one intake vents with a different output vent of the at least one output vent.

Particular embodiments may comprise one or more of the following features. The at least one output vents may comprise at least one inline vent having a pair of surfaces approximately parallel with the second surface of the outer shell proximate the inline vent, and at least one hidden vent located on the occipital cliff. The second surface may comprise an exterior output channel for each of the at least one inline vents that starts at the inline vent and extends away from the drop-off, and wherein each exterior output channel is formed in the outer surface of the helmet. At least one of the at least three chines may terminate before a front edge of the first surface. The at least one output vent may outnumber the at least one intake vent. A combined incident surface area of all of the at least one output vents may be greater than a combined incident surface area of all of the at least one intake vents. The drop-off may run continuously from one edge of the helmet to an opposite edge of the helmet.

According to an aspect, a helmet may comprise an anterior section and a posterior section defined by a coronal plane that bisects the helmet into sections having equal longitudinal length, the posterior section comprising a rear end of the helmet distal to the anterior section, an outer shell having an outer surface and an inner surface, the outer surface comprising a first surface and a second surface, the first and second surfaces joined by a drop-off running across the outer surface from a left side of the helmet to a right side of the helmet and contained within the posterior section of the helmet, a majority of a length of the drop-off being closer to the coronal plane than to the rear end of the helmet, wherein the first surface defines a top of the drop-off and the second surface defines a bottom of the drop-off, and wherein along the entire drop-off, the bottom of the drop-off is closer to a central longitudinal axis of the helmet than the top of the drop-off such that the drop-off has a height, an occipital cliff located at the rear end of the helmet and approximately perpendicular to the second surface proximate the drop-off, a plurality of vents comprising at least one intake vent in the anterior section of the helmet and at least one output vent in the posterior section of the helmet, the plurality of vents providing fluid communication between outside the helmet and inside the helmet, and an inner liner having an outer surface coupled to the inner surface of the outer shell.

Particular embodiments may comprise one or more of the following features. The drop-off may run continuously from one edge of the helmet to an opposite edge of the helmet. A visor magnetically coupled to a front of the helmet, opposite the rear end of the helmet, through at least one magnet coupled to the first surface. The visor may terminate with two lateral edges that align, respectively, with left and right sides of the first surface at the drop-off. At least three chines may extend forward from the drop off along the first surface.

According to an aspect, a helmet may comprise an outer shell having an outer surface and an inner surface, the outer surface comprising a first surface and a second surface, the first and second surfaces joined by a drop-off running across the outer surface from a left side of the helmet to a right side of the helmet, a coronal plane coplanar with a cross-section of the outer shell having a largest area enclosed within the outer surface of the outer shell, and perpendicular with a central longitudinal axis of the helmet, an anterior section anterior to the coronal plane and a posterior section posterior to the coronal plane and comprising the entire drop-off and a rear end of the helmet distal to the anterior section, an inner liner having an inner surface, and having an outer surface coupled to the inner surface of the outer shell, wherein a majority of a length of the drop-off is closer to the coronal plane than to the rear end of the helmet, and wherein the first surface defines a top of the drop-off and the second surface defines a bottom of the drop-off, and wherein along the entire drop-off, the bottom of the drop-off is closer to the central longitudinal axis of the helmet than the top of the drop-off such that the drop-off has a height.

Particular embodiments may comprise one or more of the following features. An occipital cliff may be located at the rear end of the helmet and approximately perpendicular to the second surface proximate the drop-off. A plurality of vents may comprise at least one intake vent in the anterior section of the helmet and at least one output vent in the posterior section of the helmet, the plurality of vents providing fluid communication between outside the helmet and inside the helmet. The at least one output vents may comprise at least one inline vent having a pair of surfaces approximately parallel with the second surface of the outer shell proximate the inline vent, and at least one hidden vent located on an occipital cliff, the occipital cliff located at the rear end of the helmet and approximately perpendicular to the second surface proximate the drop-off. The second surface may comprise an exterior output channel for each of the at least one inline vents that starts at the inline vent and extends away from the drop-off, and each exterior output channel may be formed in the outer surface of the helmet. A combined incident surface area of all of the at least one output vents may be greater than a combined incident surface area of all of the at least one intake vents. At least three chines may extend forward from the drop off along the first surface. The drop-off may run continuously from one edge of the helmet to an opposite edge of the helmet.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶ 6. Moreover, even if the provisions of 35 U.S.C. § 112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
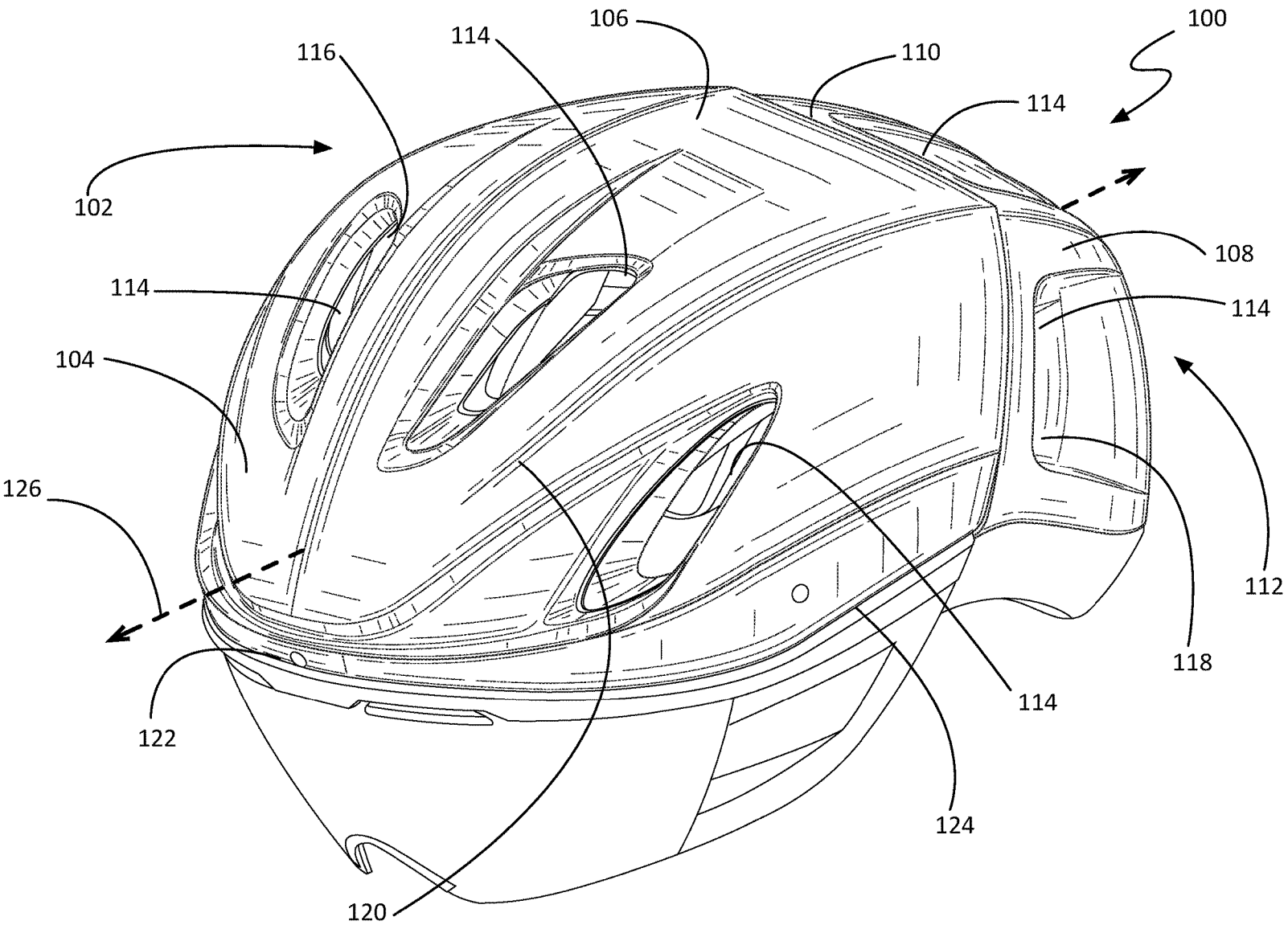
FIG. 1 is a perspective view of a truncated helmet.
Figure 2:
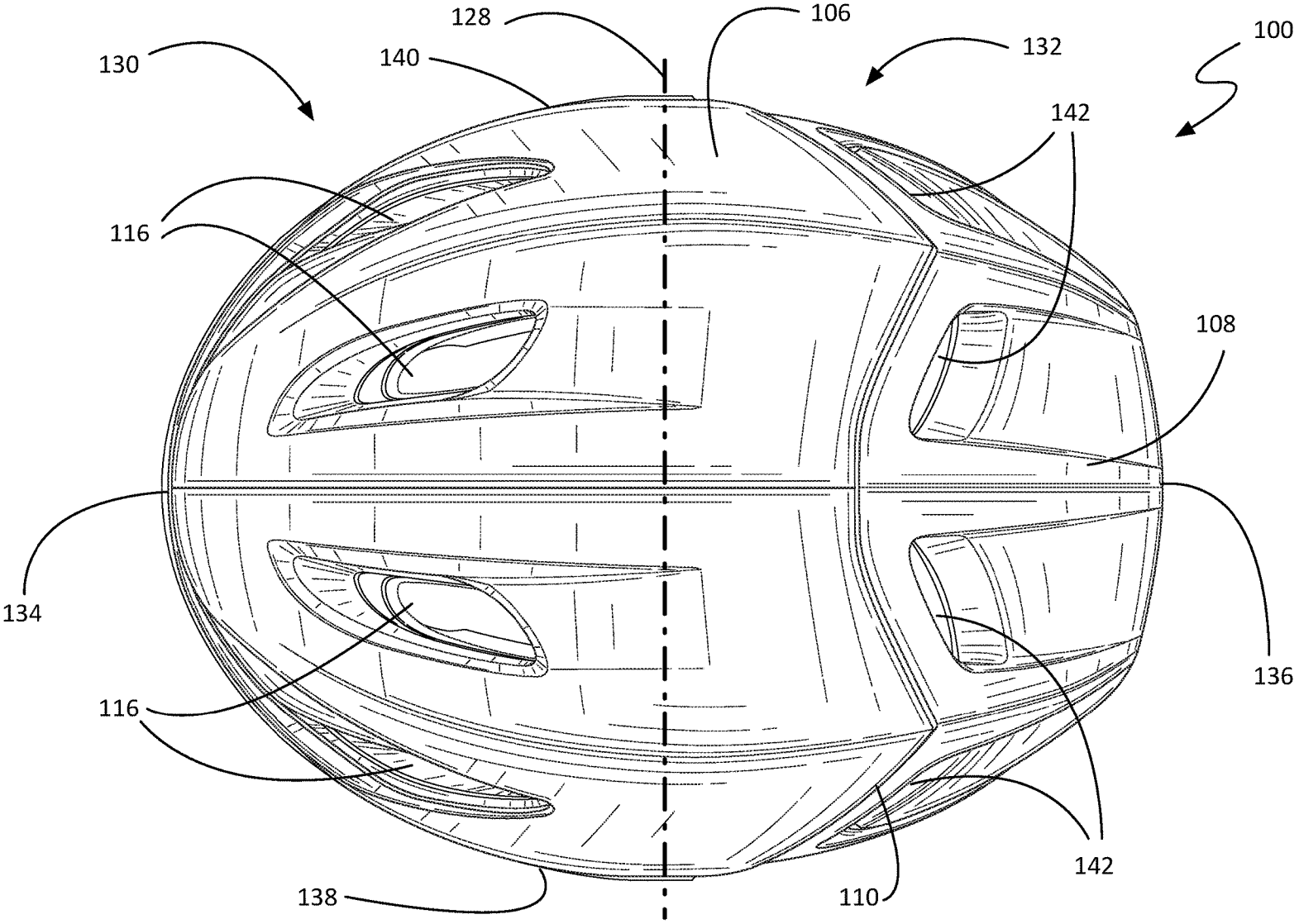
FIG. 2 is a top view of the truncated helmet of FIG. 1.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Contemplated herein is a helmet that moves through the air similar to a conventional TT helmet with its elongated tail, despite the helmets disclosed herein having a truncated tail. Surface features may control or delay the separation of the layer of air along the skin of the helmet, reducing turbulence and drag. A series of vents in the front, top, and rear of the helmet may further stabilize the flow of air over, around, and through the helmet such that it resembles the air flow around a long tapering tail, while also cooling the rider. These aerodynamic advantages may be obtained without the added weight and bulk of a conventional TT tail, and without sacrificing ventilation. Additionally, a truncated helmet may be used in races where conventional TT helmets are prohibited.

FIGS. 1 through 6 depict various views of a non-limiting example of a truncated helmet. Specifically, FIGS. 1-6 show perspective, top, bottom, side, front, and rear views of a truncated helmet 100, respectively. These and other figures, as well as the use cases and non-limiting embodiments described in this disclosure are all directed to a time trial cycling helmet. However, it should be understood that the principles, structures, designs, and other elements discussed in the context of a time trial cycling helmet may be applied to helmets adapted for use in other circumstances where reduction of aerodynamic drag is advantageous.

As shown, the truncated helmet 100 comprises an outer shell 102, an inner liner 144, a drop-off 110, an occipital cliff 112, a plurality of vents 114, and a plurality of chines 120, according to various embodiments. Each of these elements, and their contribution to the aerodynamic advantages of the truncated helmet 100, will be discussed in greater detail below.

As shown, the truncated helmet 100 may have a front that is rounded and a back that is abruptly flattened, a drastic departure from the design of conventional, teardrop shaped TT helmets. The non-limiting example shown in FIGS. 1-6 comprises an outer shell 102 having an outer surface 104, and an inner liner 144 having an inner surface 146. Not shown is the inner surface of the outer shell 102 and the outer surface of the inner liner 144, which are coupled to each other. In the context of the present description and the claims that follow, the outer shell 102 may be the component that comprises the outermost surface of the helmet, over which air will flow when in use by a cyclist. Examples include, but are not limited to, a thick layer of hard material such as polycarbonate (PC), a layer of energy absorbing material such as expanded polystyrene (EPS) that has a thin layer of PC, and the like.

According to various embodiments, the inner liner 144 may be a helmet body that couples with an outer shell 102 and that is composed of energy absorbing materials. In some embodiments, truncated helmet 100 may further utilize a fit system (i.e. the system that provides a wearer with a snug, comfortable, functional fit) that maintains a space between the wearer's head and the inner liner 144 to maintain airflow.

In some embodiments, the helmet 100, or in particular embodiments the outer shell 102 of the truncated helmet 100, may be formed from two or more pieces, each having at least a partial smooth shell over an energy absorbing material. Additionally, the inner liner 144 may be a single piece, or multiple pieces, according to various embodiments. In other embodiments, the helmet 100 may be a single piece of energy absorbing material covered with a smooth outer shell.

In the context of a cycling helmet, aerodynamic drag may be broken into two components, surface friction and pressure drag. Surface friction is the drag caused by the interaction of the helmet's surface with viscous air, within the boundary layer. The boundary layer is discussed in greater detail below. Pressure drag refers to the drag caused by the buildup of high static pressure in front of the helmet, and the low-pressure zone behind a helmet, essentially pulling the helmet backwards. While pressure drag has the greatest effect on a cyclist, surface friction is non-negligible and a productive area of optimization. Elements of the truncated helmet 100 contemplated herein address both types of drag.

As shown in FIGS. 1, 2, 4, and 6, the outer surface 104 of the helmet 100 makes a small, but sharp drop inward while moving from the front to the back. This drop-off 110 runs across the top of the helmet 100, from the left side 138 to the right side 140, and serves to manipulate the boundary layer of air flowing over the helmet 100 in advantageous ways.

In the context of the present description, a boundary layer refers to the layer of air in the immediate vicinity of the outer surface 104 of the helmet 100, within which the effects of viscosity are significant. The boundary layer may be described as having a thickness. The boundary layer thickness is the distance across a boundary layer from a surface to a point where the flow velocity has essentially reached the 'free stream' velocity (customarily defined as 99% of the free stream velocity) and viscosity plays a negligible role. Other definitions of boundary layer thickness focus on the needed displacement of the surface in an inviscid fluid to match the velocity, momentum, or kinetic energy of the surface in a real fluid.

A fluid dynamic event that can have negative aerodynamic consequences is inadvertent boundary layer separation. The boundary layer tends to thicken as it continues over a surface, all things being equal. Instabilities and/or competing forces such as adverse pressure may cause the boundary layer to peel away from the surface at an angle, effectively increasing the aerodynamically-viewed size of the helmet. This may dramatically increase the pressure drag the helmet experiences. Such consequences may be avoided by controlling the boundary layer separation.

The outer surface 104 of the outer shell 102 comprises a first surface 106 and a second surface 108. As seen in the side view of FIG. 4, the drop-off 110 is formed at the junction of the first surface 106, which (near the junction) is the top 160 of the drop-off 110, and the second surface 108, which (near the junction) is the bottom 162 of the drop-off 110, giving the drop-off 110 a height 164. In some embodiments, the height 164 of the drop-off 110 may be roughly the same order of magnitude as the thickness of the boundary layer.

In some embodiments, the drop-off 110 may have a height 164 that is constant for the entire drop-off 110. In other embodiments, the height 164 of the drop-off 110 may vary.

As an option, variances in the height 164 may be based upon variances in the boundary layer thickness due to the shape of the helmet 100.

In some embodiments, the drop-off 110 may be sized such that, before competing forces and instabilities are able to cause the boundary layer to separate from the outer surface 104 at an angle, an intentional boundary layer separation occurs, causing the boundary layer to continue close to, but separated from, the outer surface 104. Such a redirection of a separated boundary layer may reduce the aerodynamic profile of the helmet 100 (in comparison to the case with an inadvertent boundary layer), and may also reduce the size of a low-pressure zone behind the helmet 100.

In other embodiments, the drop-off 110 may be sized such that a boundary layer transition occurs before the point of separation. Boundary layers may be categorized as either laminar or turbulent. Near the front of the helmet 100 the boundary layer may be laminar, meaning a very smooth, orderly flow. Laminar boundary layers are advantageous as they result in low surface friction. However, they tend to be unstable, and easily susceptible to adverse pressure and separation. A turbulent boundary layer is made up of swirls and eddies; surface friction is increased, but so is the overall energy, making a turbulent boundary layer more resistant to competing forces and less likely to separate from the surface.

The drop-off 110 may trigger a transition from a laminar boundary layer to a turbulent boundary layer, which may prevent or delay an inadvertent separation. In some embodiments, the boundary layer may continue to hug the surface of the helmet 100, beyond the drop-off 110, until running off the rear 136 of the helmet 100 at an angle more aerodynamically favorable than would be seen in an inadvertent separation.

In still other embodiments, the drop-off 110 may perform both functions, causing a portion (e.g. the higher velocity portion of the boundary layer that is further away from the helmet 100) of the boundary layer to separate and continue along a favorable trajectory, and the remaining boundary layer to transition to a turbulent boundary layer, resisting separation and continuing to hug the outer surface 104. Additionally, controlling the point of separation and/or nature of the boundary layer may further serve to reduce the wind noise the wearer experiences while riding.

The "drop" at the drop-off 110 occurs while moving from the front of the helmet to the back. In other words, along the entire drop-off 110, the bottom 162 of the drop-off 110 is closer to a central longitudinal axis 126 of the helmet 100 than to the top 160 of the drop-off 110. In the context of the present description and the claims that follow, a central longitudinal axis 126 is an axis running longitudinally (i.e. front to back) and roughly centered within the profile of the outer shell 102.

According to various embodiments, the location where the drop-off 110 runs across the top of the outer surface 104 of the outer shell 102 may be described with respect to various aspects of the overall shape of the helmet 100. For example, in some embodiments, the drop-off 110 is positioned on the helmet 100 proximate to, and in front of, the point of inadvertent boundary layer separation, for a particular orientation of the helmet 100 (e.g. orientation associated with the ideal angle of a riders head when racing, etc.). The location of inadvertent boundary layer separation may depend on the shape and material of the helmet 100, the orientation it is being held at, and the speed of the air flowing over the surface.

In other embodiments, the location of the drop-off 110 may be described in relation to a coronal plane 128 passing through the helmet 100. In the contexts of the present description and the claims that follow, a coronal plane 128 is a plane that is perpendicular to the central longitudinal axis 126 and that passes through the helmet 100, dividing it into an anterior section 130 containing the front 134 of the helmet and a posterior section 132 containing the rear 136 of the helmet 100. According to some embodiments, the drop-off 110 is positioned such that at least a majority of the length of the drop-off is closer to the coronal plane 128 than to the rear end 136 of the helmet 100.

Figure 7:
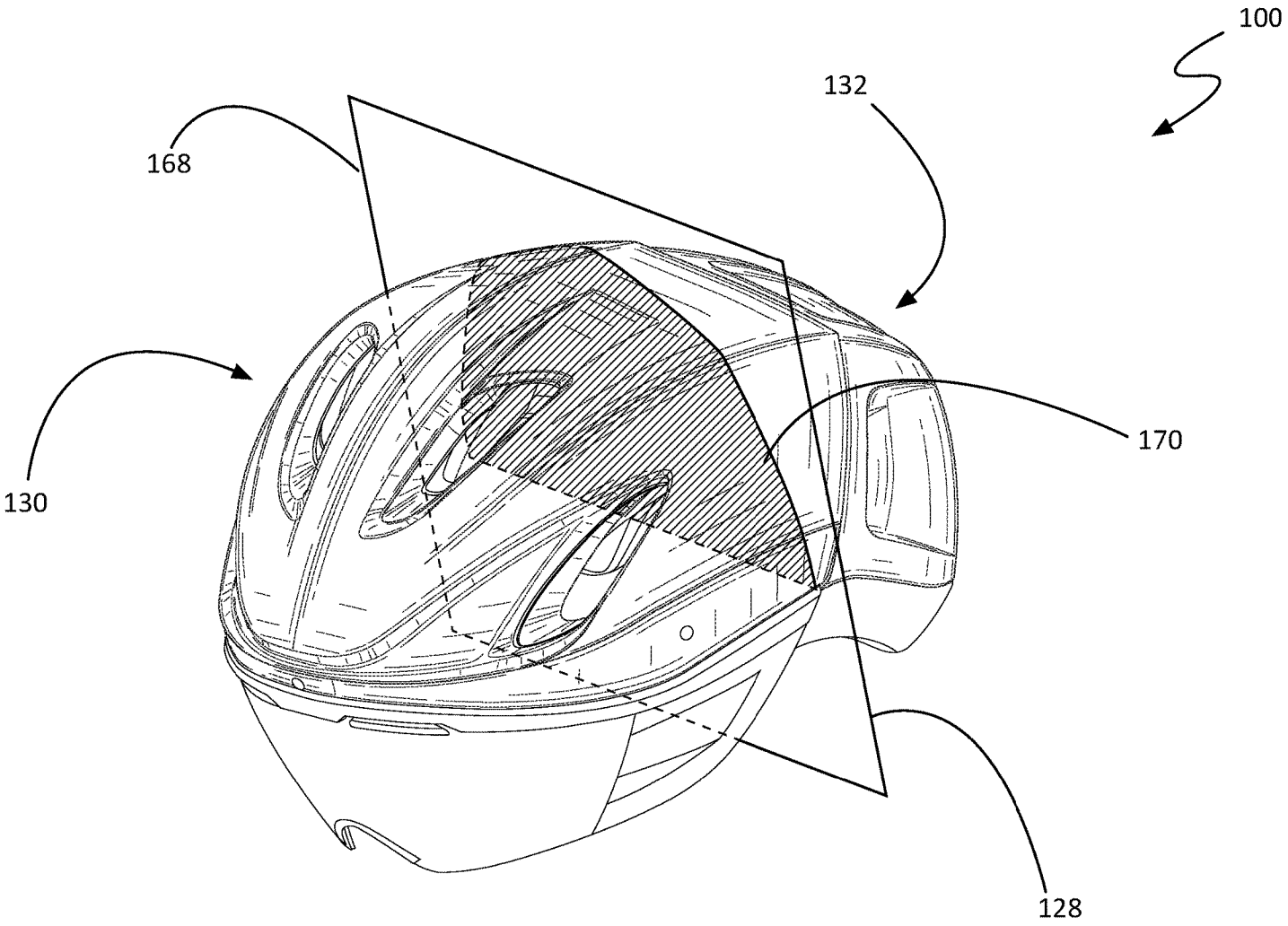
FIG. 7 is a perspective view of a cross-section of a truncated helmet.

In some embodiments, the coronal plane 128 may most appropriately be defined as the plane that bisects the helmet 100 into sections having equal longitudinal length. See, for example, the coronal plane 128 of FIGS. 2 and 4. These embodiments may include helmets 100 tending to have greater longitudinal symmetry. In other embodiments, it may be more appropriate to define the coronal plane 128 as being coplanar with a cross-section 168 of the outer shell 102 at a longitudinal location having a largest cross-sectional planar area 170 enclosed within the outer surface 104 of the outer shell 102. See, for example, FIG. 7. Such embodiments may include helmets 100 having lower longitudinal symmetry. How the most appropriate coronal plane 128 is defined depends upon the location of the inadvertent boundary layer separation that is to be manipulated, which in turn depends upon the factors previously discussed. In some cases, either definition of the coronal plane 128 may be effective. In still other embodiments, a different coronal plane 128 may be more suitable for providing an aerodynamic advantage.

Independent of how the coronal plane 128 is defined, the drop-off 110 is located, at least in part, within the posterior section 132, or in other words, located in part behind the coronal plane 128. In some embodiments, the drop-off 110 may be located entirely behind the coronal plane 128 (i.e. in the posterior section 132).

In some embodiments, including those shown in FIGS. 1-6, the drop-off 110 may be non-planar. For example, it may arc between chines 120, as shown. In other embodiments the drop-off 110 may run straight across the helmet 100, while in still other embodiments the drop-off 110 may follow a different path across the outer surface 104. Additionally, in some embodiments, the drop-off 110 may run from one edge 124 of the helmet 100 to an opposite edge 124. Also, the drop-off 110 may be continuous, meaning it is defined (e.g. has a height 164) for its entire run across the outer surface 104. In still other embodiments, the drop-off 110 may run across only a portion of the top of the helmet. In other embodiments, the drop-off 110 may have one or more points at which it does not exist (e.g. points where the first surface 106 and the second surface 108 are even).

In some embodiments, the truncated rear end 136, or occipital cliff 112, of the helmet 100 may also serve as an additional drop-off, meaning it may be used to manipulate the boundary layer. As an option, the occipital cliff 112 may be tuned to perform its function when the helmet 100 is at a yaw/pitch angle different than what is assumed for the drop-off 110. This may serve to expand the functionality of the truncated helmet 100, providing aerodynamic advantages in conditions (e.g. orientation, air speed, etc.) beyond the conditions targeted in the placement and sizing of the drop-off 110.

Figure 4:
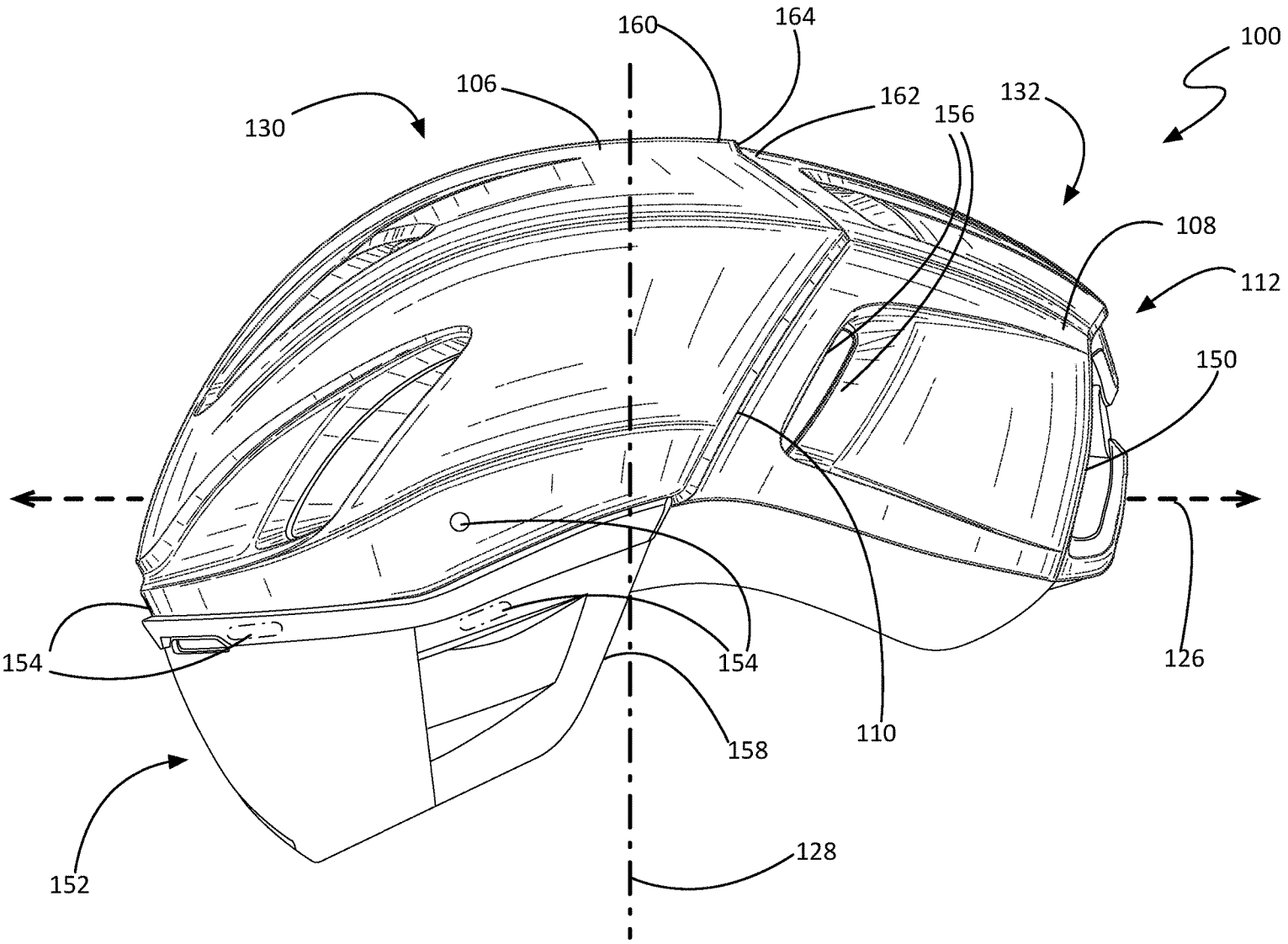
FIG. 4 is a side view of the truncated helmet of FIG. 1.
Figure 6:
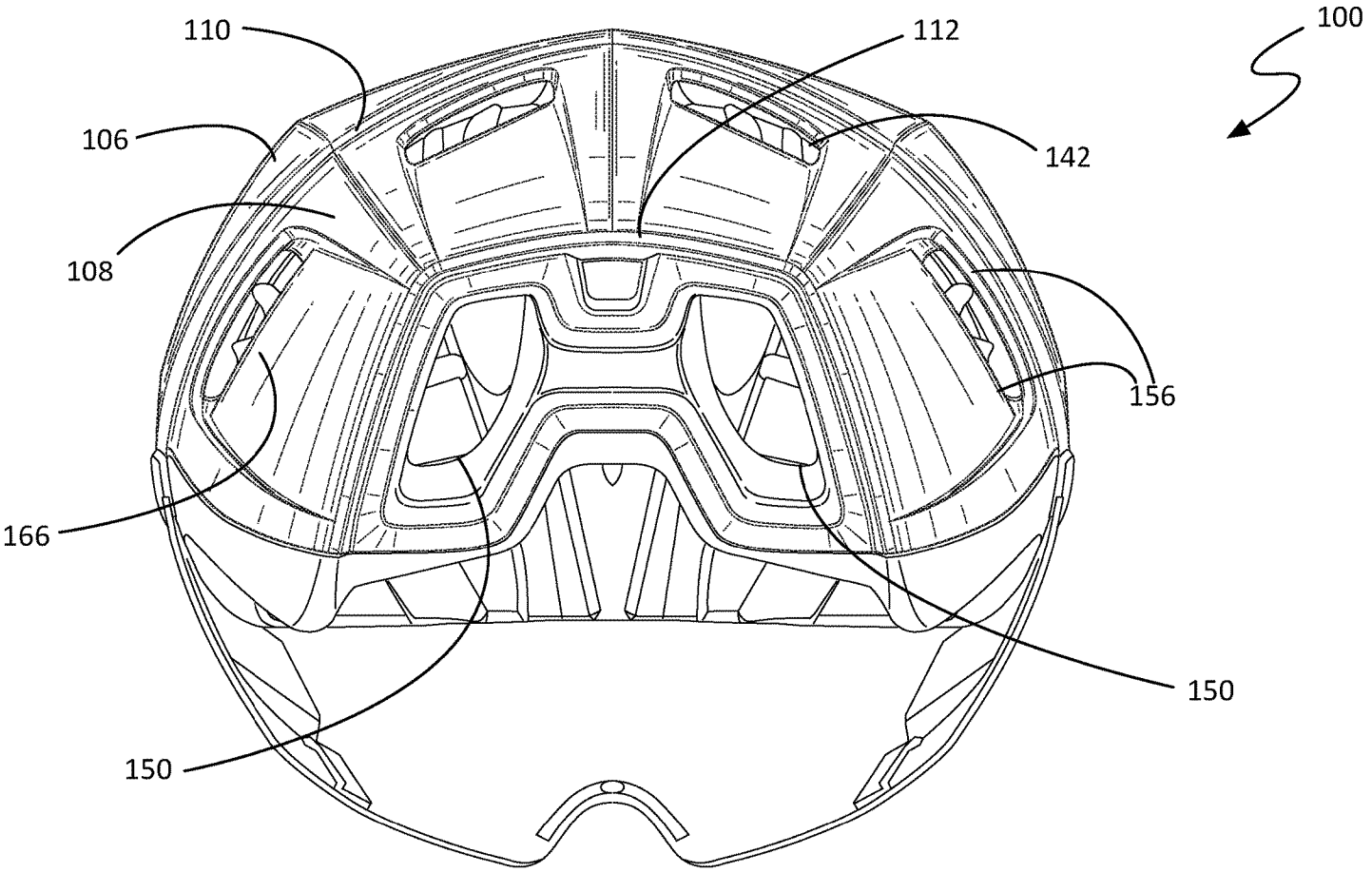
FIG. 6 is a rear view of the truncated helmet of FIG. 1.

As shown in FIGS. 4 and 6, the occipital cliff 112 is a sharp drop at the rear 136 of the helmet 100. In some embodiments, the occipital cliff 112 (or a plane representing the average topology of a non-planar occipital cliff 112) may be approximately perpendicular to the second surface 108 of the outer surface 104, proximate the drop-off 110. In the context of the present description and the claims that follow, approximately perpendicular means within 20° of perpendicular. In other embodiments, the occipital cliff 112 may meet the second surface 108 at approximately the same angle the top 160 of the drop-off 110 meets the drop-off 110 itself, though the drop-off 110 and the occipital cliff 112 are not necessarily parallel.

While the truncated helmet 100 may achieve some of the aerodynamic advantages of conventional time trial helmets, it may also be aerodynamically superior to conventional time trial helmets in other ways, according to various embodiments. For example, conventional helmets, with their long tails, perform well in the idealized zero pitch/zero yaw orientation. However, the long tail may become a liability in other orientations, where it may actually increase drag. The truncated helmet 100, lacking the long tail, may perform better in those orientations, or in situations with an undesirably strong cross wind.

As seen in FIGS. 1-6, a truncated helmet 100 may have a plurality of vents 114 located at the front, along the top, and at the rear of the helmet 100, providing fluid communication between outside the helmet 100 and inside the helmet 100. According to various embodiments, these vents 114 are shaped and/or located such that they create as little turbulence as possible. Some vents 114, such as the output vents 118 in the posterior section 132, achieve this by being located past the drop-off 110 and sheltered from the boundary layer, while others, such as the intake vents 116 in the anterior section 130, may be placed such that they line up with the flow of oncoming air.

In some embodiments, the truncated helmet 100 may be shaped to guide the airflow with respect to the vents 114. As shown in FIGS. 1, 2, 4 and 5, the outer surface 104 proximate the intake vents 116 may be shaped to facilitate the orderly flow of air into the vents while minimizing turbulence and avoiding disruption to the boundary layer continuing over the outer surface 104. Furthermore, as shown, in some embodiments the intake vents 116 may be elongated in the direction of airflow over the helmet 100. In other embodiments, the intake vents 116 (as well as other vents 114) may have other shapes known in the art.

FIGS. 4 and 6 illustrate that the inline vents 114 on top of the helmet 100 may be paired with exterior output channels 166 that slope down the back of the helmet and inward, tapering toward a non-existent tail. These channels 166 may be formed in the second surface 108 of the outer shell 102, starting at the inline vent 142 and extending away from the drop-off 110, according to various embodiments. These channels 166 may serve to guide the airflow in a beneficial direction. According to some embodiments, the inline vents 142 may help stabilize the boundary layer by injecting air (and momentum) into the layer along the direction it is flowing, minimizing any disruption. Such a function may be particularly advantageous in embodiments where the boundary layer past the drop-off 110 is a turbulent boundary layer. As shown, the inline vents 142 may be smaller than the hidden vents 150, in some embodiments.

As seen in the non-limiting embodiment of FIG. 6, the truncated helmet 100 has hidden vents 150 at the rear of the helmet 100, on the occipital cliff 112. In some embodiments, including the embodiment depicted in FIG. 6, the rear vents may be larger than the inline vents 142. FIG. 6 shows an embodiment having two hidden vents 150. Other embodiments may have one hidden vent 150, or more than two. As shown, the hidden vents 150 are slightly angled, pointing toward the tip of a non-existent tail, similar to the exterior output channels 166 formed in the outer surface 104 of the outer shell 102, behind the inline vents 142. According to various embodiments, an inline vent 142 may comprise a pair of surfaces 156 at least partially inside the vent that are approximately parallel with the second surface 108 of the outer shell 102 proximate the inline vent 142. In other words, these surfaces 156 point the outgoing air flow along the second surface 108, which may prevent disruptions of the boundary layer and/or inject momentum to the boundary layer, which may or may not be transitioning. In the context of the present description and the claims that follow, this pair of surfaces 156 of the inline vent 142 is approximately parallel to the second surface 108 when they are within 20° of the second surface 108.

According to various embodiments, the output vents 118 (e.g. inline vents 142, hidden vents 150) may provide an aerodynamic advantage by increasing the air pressure in the zone behind the helmet 100, which is often the location of significant pressure drag. Furthermore, the intake vents 116 may serve to reduce the high pressure in front of the helmet 100. An additional advantage of the truncated helmet 100 over conventional time trial helmets is that the vents 114, while providing beneficial aerodynamics, also provide ventilation for the rider, increasing their comfort. Conventional TT helmets often sacrifice ventilation to improve aerodynamics; the truncated helmet 100 does not have to make such a trade-off.

Figure 3:
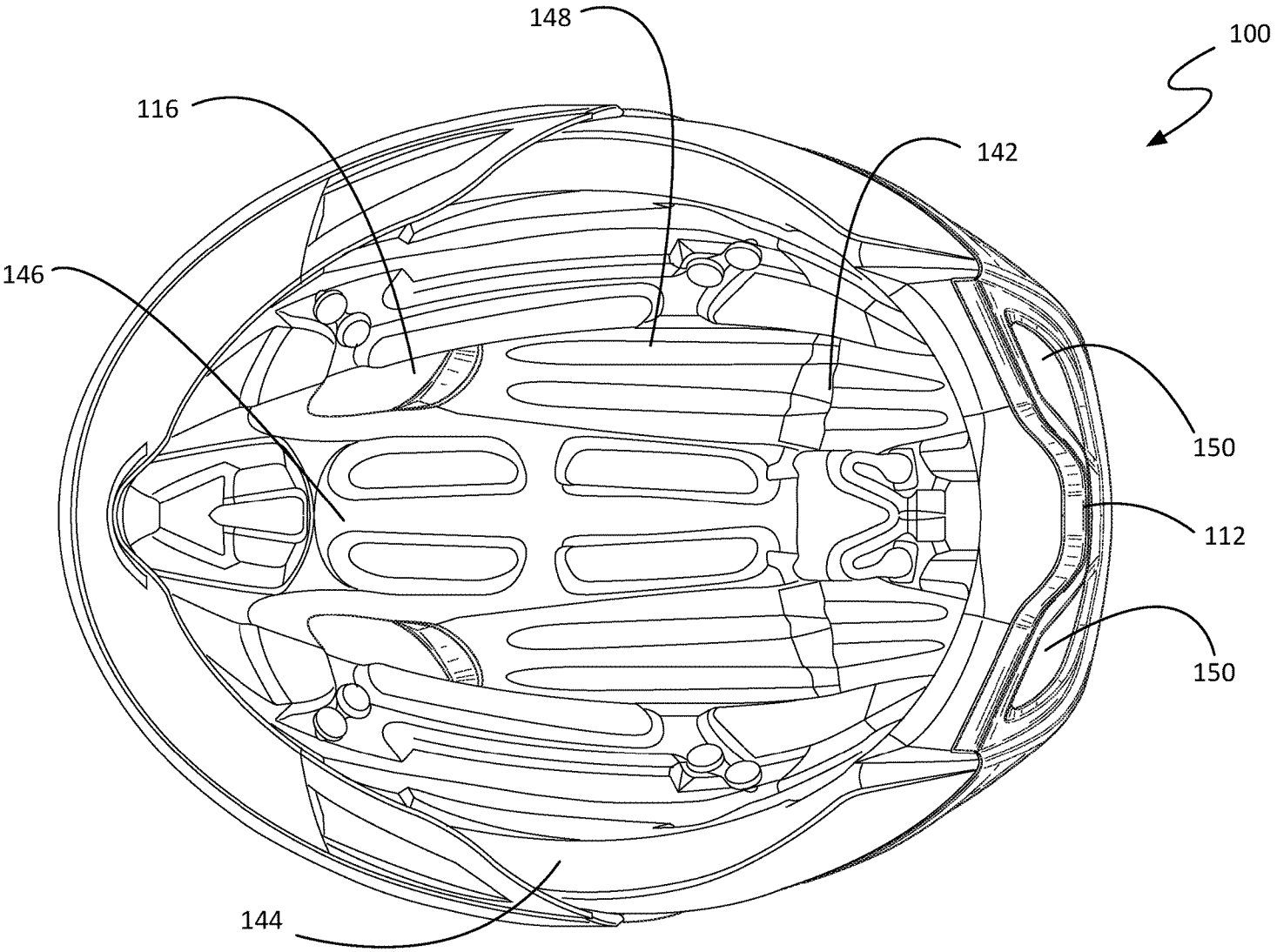
FIG. 3 is a bottom view of the truncated helmet of FIG. 1.

FIG. 3 depicts a bottom view of a non-limiting embodiment of a truncated helmet 100. As shown, the inner surface 146 of the inner liner 144 may comprise a series of interior channels 148 running between each intake vent 116 at the front of the helmet 100, and the output vents located in the posterior section 132 of the helmet 100. As an option, the interior channels 148 may be private, meaning each intake vent 116 is connected to an output vent 118, and no output vent 118 is connected to more than one intake vent 116. According to various embodiments, these interior channels 148 may be shaped and positioned to provide a clean path for the air to follow, reducing the amount of turbulence introduced. As seen, the interior channels 148 may get larger, moving from front to back, to reduce the air pressure and further promote airflow through the helmet 100. Additionally, the interior channels 148 may have one or more guides to further reduce turbulence.

In some embodiments, the size of the interior channels 148 may be such that the velocity of the air leaving the inline vents 142 is different than the velocity of the air leaving the hidden vents 150. According to some embodiments, the interior channels 148 may also facilitate the ventilation of a wearer's head, increasing comfort with the cooling needed at high levels of exertion.

Figure 8A:
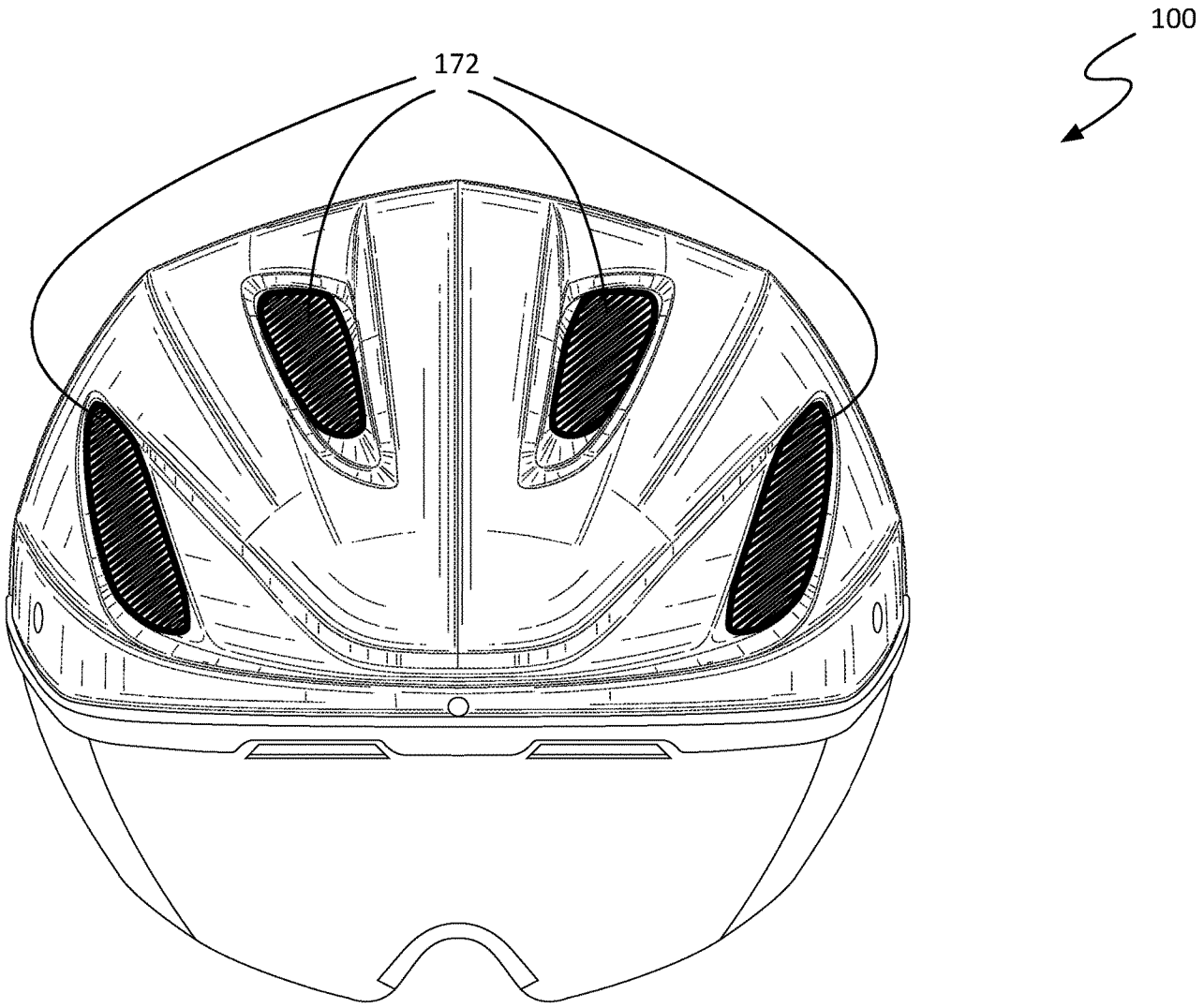
FIG. 8A is a front view of a truncated helmet highlighting input vents.
Figure 8B:
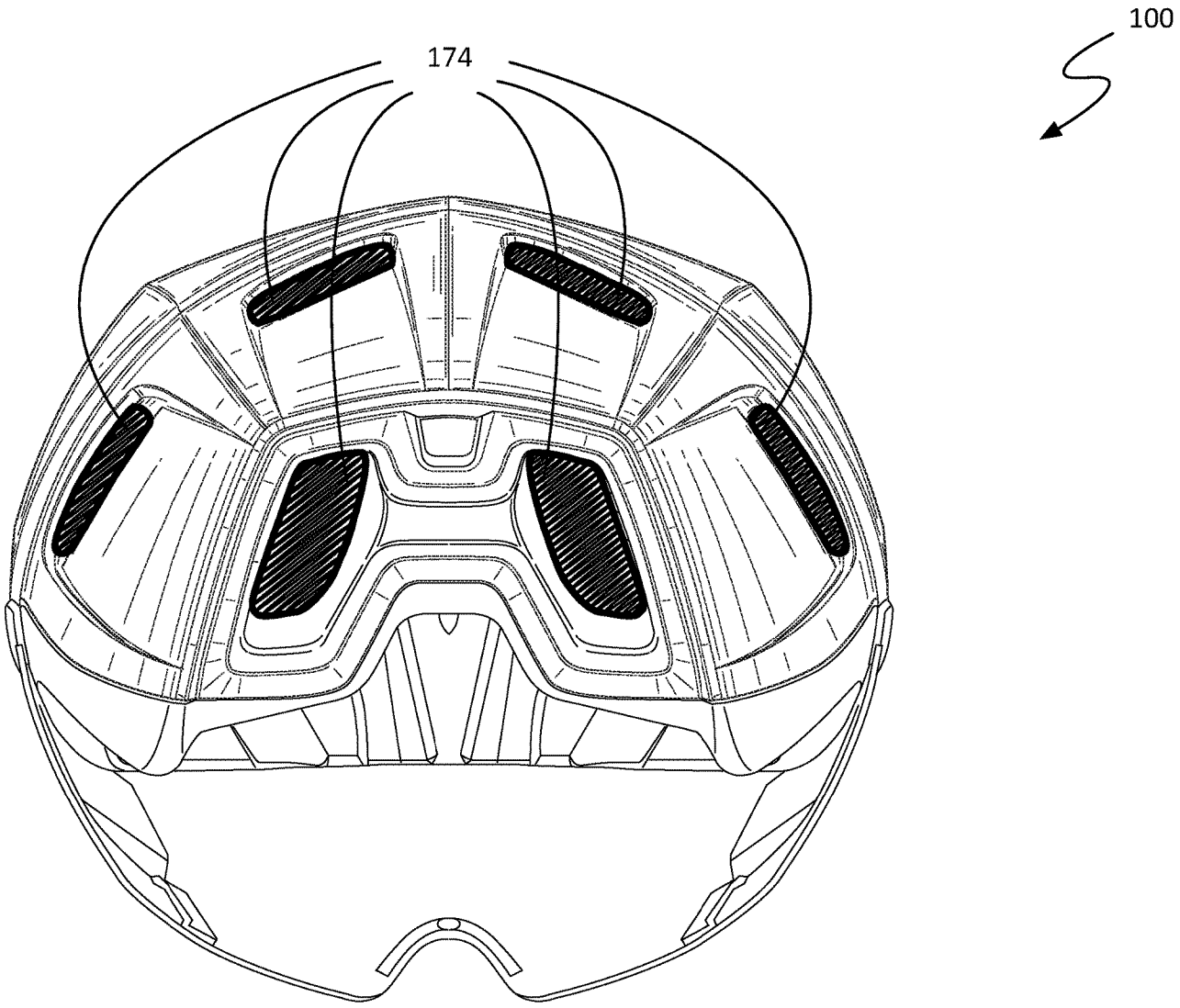
FIG. 8B is a rear view of the helmet of FIG. 8A highlighting output vents.

Having more output vents than intake vents may also facilitate a reduction of air pressure. FIGS. 1-6 show a non-limiting embodiment having four intake vents 116 in the front and a total of six output vents 118. In some embodiments, the combined incident surface area 174 of all output vents 118 is greater than the combined incident surface area 172 of all intake vents 116, as depicted in FIGS. 8A and 8B. In the context of the present description and the claims that follow, an incident surface area of a vent is the area of the cross-section of the vent that is perpendicular to the airflow. The combined incident surface area for a collection of vents is simply the sum.

According to various embodiments, a series of chines 120, or convex bone lines, may run longitudinally along the top and sides of the outer surface 104 of the truncated helmet 100. According to various embodiments, the chines 120 may extend forward from the drop-off 110 along the top of the helmet 100. These chines 120 may further serve to break up the round shape of the front of the helmet 100, bringing stability by giving the helmet 100 direction and facilitating the movement of air over the helmet 100. Furthermore, the chines 120 may make the point of boundary layer separation more predictable, increasing the efficacy of the drop-off 110.

Figure 5:
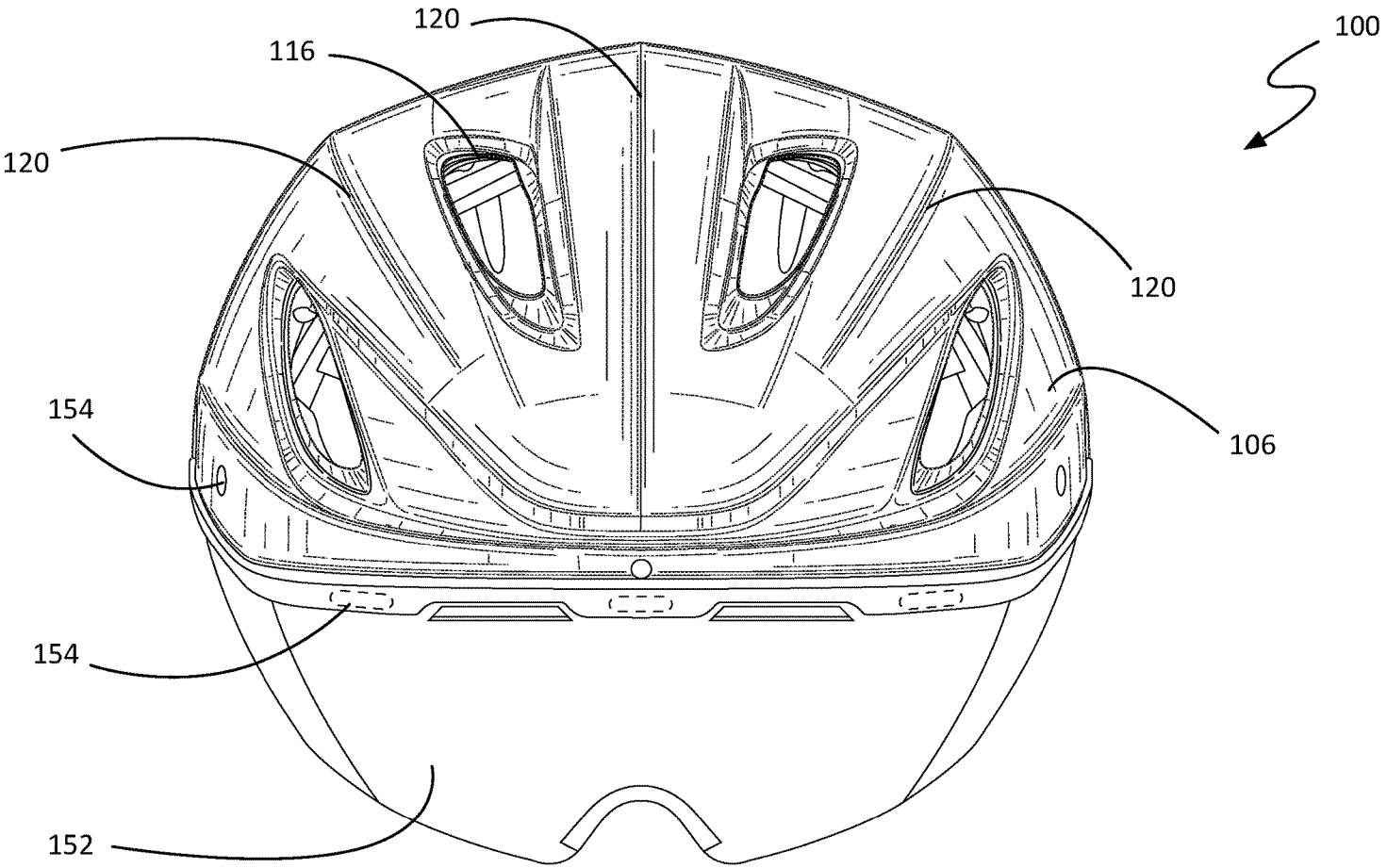
FIG. 5 is a front view of the truncated helmet of FIG. 1.

The non-limiting embodiment shown in FIGS. 1-6 has 5 chines 120; other embodiments may have more than 5, or less (e.g. 3 chines, etc.) and may be of different shape and severity, depending upon the overall helmet shape and intended use conditions (e.g. helmet orientation, characteristic air speed, etc.). A chine is an intersection of two surfaces that forms a change in direction from one surface to the next, such as on the hull of a boat. As shown in FIGS. 1 and 5, the chines 120 may terminate, or loop, before reaching the front edge 122 of the first surface 106 of the outer shell 102. In other embodiments, a chine 120 may run right up to the front edge 122.

As shown, the truncated helmet 100 may comprise a series of magnets 154 near the lower edge of the front 134 of the helmet 100 (e.g. the circles and bars in FIGS. 1, 4, and 5). In some embodiments, the magnets 154 may be embedded within the energy absorbing material beneath the outer shell 102 of the helmet 100. In other embodiments, the magnets 154 may be coupled to the first surface 106 of the outer shell 102. As a specific example, a magnet 154 may be embedded in the energy absorbing material of the outer shell 102, and subsequently bonded with the plastic layer applied to the outer shell 102, forming a smooth, reduced-friction outer surface 104. These magnets 154 may be used to releasably couple a visor 152 to the helmet 100 to protect the wearer's eyes from the airflow, and to further streamline the movement of air around the helmet 100. In other embodiments, other means of attachment known in the art may be used between the visor 152 and the helmet 100.

FIG. 1 shows a perspective view of a non-limiting embodiment of a truncated helmet 100 with a visor 152 in a deployed position. The visor 152 is held in place by magnets or ferromagnetic material within the visor 152 being attracted to magnets 154 within the body of the truncated helmet 100 (e.g. outer shell 102, inner liner 144, etc.). This allows for a conveniently releasable attachment that does not interrupt the aerodynamic, smooth outer surface of either the visor 152 or the helmet 100 when the visor 152 is removed. When attached in the deployed position and the rider's head is in riding position wearing the helmet, the visor 152 may help to direct air around the helmet 100 and down over the riders chest, while avoiding the less-than-aerodynamic face of the rider.

According to various embodiments, the visor 152 may be attached to the helmet 100 in a storage position, allowing a wearer to have an unobstructed view when not racing without having to worry about scratching or possibly losing the visor 152. In some embodiments, the visor 152 may be attached upside down to the same set of magnets 154 in the helmet 100 used in the deployed position. In other embodiments, including the non-limiting example shown in FIG. 1, a second set of magnets 154 may be included, further up in the helmet 100. The use of a second set of magnets 154 may be advantageous, as this allows the "deployed" set of magnets 154 to be set within a lip, such that when the visor 152 is in the deployed position, it is flush with the outer surface 104 of the outer shell 102 proximate the edge of the visor 152.

FIG. 4 shows a side view of a non-limiting embodiment of a truncated helmet 100 with a visor 152 in a deployed position. As shown, the lateral edge 158 of the visor 152 is in line with the drop-off 110, continuing it down across the side of the rider's face. Specifically, the lateral edges 158 of the visor 152, while in the deployed position, align with the left and right sides of the first surface 106 at the drop-off 110 (i.e. the top 160 of the drop-off 110). By aligning the lateral edge 158 of the visor 152 with the drop-off 110, the aerodynamic advantages provided by the drop-off 110 may be extend around more of the rider's head without having to increase the size or weight of the helmet 100 itself. Additionally, extending the drop-off 110 along the side of the visor 152 may further shield the wearer's ears from the flow of air, increasing comfort and reducing noise, turbulence, and drag.

Various implementations and embodiments of protective helmets according to this disclosure comprise a protective shell. The protective shell can be made of an energy absorbing material, such as expanded polystyrene (EPS), expanded polyurethane (EPU), expanded polyolefin (EPO), expanded polypropylene (EPP), or other suitable material. The energy absorbing material can include an additional outer protective shell disposed outside, or over, the protective shell. As an energy-absorbing layer in an in-molded helmet, the protective shell can comprise rigid materials such as EPS and EPU. An outer shell layer, such as a layer of stamped polyethylene terephthalate (PET) or a polycarbonate shell, can be included on an outer surface of the protective shell of the helmet and be bonded directly to the expanding foam (e.g. EPS as it is expanding such that the foam is molded in the shell). In some embodiments, the truncated helmet 100 may be composed of more than one in-molded element, each element having its own, at least partial, outer shell layer.

As a specific example of the non-limiting embodiment shown in FIGS. 1-6, a rider dons the helmet and begins peddling. Air flows around and over the helmet 100, as well as into the intake vents 116 at the front. The air coming in to the helmet 100 through the intake vents 116 moves along interior channels 148 in the inner surface 146 of the inner liner 144, inhibiting the introduction of turbulence to the flow as it passes through the inside of the helmet 100. In addition to providing increased ventilation to the rider's head, the air flow exits the helmet 100 through a number of inline vents 142 along the top of the second surface 108, as well as two hidden vents 150 in the occipital cliff 112. The air coming out of the inline vents 142, still somewhat laminar as it was when entering the intake vents 116, continues along the second surface 108 away from the drop-off 110 without overly expanding the effective size of the helmet 100. The air flowing out of the hidden vents 150 at the back is somewhat more turbulent, but serves to reduce a low pressure zone forming behind the helmet, helping to alleviate pressure drag and spreading the flows coming off the second surface 108 and reinforcing an effective tail.

As for the air flowing over and around the helmet 100, as the rider approaches a characteristic speed, with their head held at an optimal orientation (for which the helmet 100 was calibrated), the drop-off 110 manipulates the boundary layer such that boundary layer separation is triggered before a turbulent inadvertent boundary layer separation can occur. The early triggering of the boundary layer separation creates a separated layer that has the stability due to the introduction of turbulence but also the needed momentum and coherence to continue along the second surface 108, reducing surface drag. As the separated boundary layer arrives at the occipital cliff 112, it continues on a path tapering inward to form the outside of the effective tail.

The overall effect is a reduction in pressure and surface drag, and the inhibition of inadvertent boundary layer separation that would result in an increased effective size of the helmet. The intentional boundary layer separation caused by the drop-off 110 maintains some degree of order in the air flowing over the second surface 108, without appreciably increasing the effective size of the helmet. This allows the free stream air to move over the helmet 100 efficiently, reducing drag. Furthermore, the airflow at the rear of the helmet reduces the adverse forces and further inhibits inadvertent boundary layer separation.

Where the above examples, embodiments and implementations reference examples, it should be understood by those of ordinary skill in the art that other helmets and examples could be intermixed or substituted with those provided. In places where the description above refers to particular embodiments of truncated helmets and customization methods, it should be readily apparent that a number of modifications may be made without departing from the spirit thereof and that these embodiments and implementations may be applied to other to helmet optimization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an anterior section and a posterior section defined by a coronal plane that bisects the helmet into sections having equal longitudinal length, the posterior section comprising a rear end of the helmet distal to the anterior section;

an outer shell having an outer surface and an inner surface and a perimeter edge, the outer surface comprising:

a first surface and a second surface, the first and second surfaces joined by a drop-off extending across the outer surface from a bottom left perimeter edge of the outer shell to a bottom right perimeter edge of the outer shell opposite the bottom left perimeter edge and contained within the posterior section of the helmet, a majority of a length of the drop-off being closer to the coronal plane than to the rear end of the helmet, wherein the first surface defines a top of the drop-off and the second surface defines a bottom of the drop-off, and wherein along the entire drop-off, the bottom of the drop-off is closer to a central longitudinal axis of the helmet than the top of the drop-off such that the drop-off has a height; and at least three chines extending forward from the drop off along the first surface;

an occipital cliff located at the rear end of the helmet and approximately perpendicular to the second surface proximate the drop-off;

a plurality of vents comprising at least one intake vent in the anterior section of the helmet and at least one output vent in the posterior section of the helmet, the plurality of vents providing fluid communication between outside the helmet and inside the helmet; and an inner liner having an outer surface coupled to the inner surface of the outer shell and an inner surface comprising a plurality of interior channels connecting each of the at least one intake vents with a different output vent of the at least one output vent.

2. The helmet of claim 1, wherein the at least one output vents comprises at least one inline vent having a pair of surfaces approximately parallel with the second surface of the outer shell proximate the inline vent, and at least one hidden vent located on the occipital cliff.

3. The helmet of claim 2:

wherein the second surface comprises an exterior output channel for each of the at least one inline vents that starts at the inline vent and extends away from the drop-off; and wherein each exterior output channel is formed in the outer surface of the helmet.

4. The helmet of claim 1, wherein at least one of the at least three chines terminates before a front edge of the first surface.

5. The helmet of claim 1, wherein the plurality of vents comprise more output vents than intake vents.

6. The helmet of claim 1, wherein a combined incident surface area of all of the at least one output vents is greater than a combined incident surface area of all of the at least one intake vents.

7. The helmet of claim 1, wherein the drop-off runs continuously from the bottom left perimeter edge of the outer shell to the bottom right perimeter edge of the outer shell.

8. A helmet, comprising:

an anterior section and a posterior section defined by a coronal plane that bisects the helmet into sections having equal longitudinal length, the posterior section comprising a rear end of the helmet distal to the anterior section;

an outer shell having an outer surface and an inner surface, the outer surface comprising a first surface and a second surface, the first and second surfaces joined by a drop-off extending across the outer surface from a bottom left perimeter edge of the outer shell to a bottom right perimeter edge of the outer shell and contained within the posterior section of the helmet, a majority of a length of the drop-off being closer to the coronal plane than to the rear end of the helmet, wherein the first surface defines a top of the drop-off and the second surface defines a bottom of the drop-off, and wherein along the entire drop-off, the bottom of the drop-off is closer to a central longitudinal axis of the helmet than the top of the drop-off such that the drop-off has a height;

an occipital cliff located at the rear end of the helmet and approximately perpendicular to the second surface proximate the drop-off;

a plurality of vents comprising at least one intake vent in the anterior section of the helmet and at least one output vent in the posterior section of the helmet, the plurality of vents providing fluid communication between outside the helmet and inside the helmet; and an inner liner having an outer surface coupled to the inner surface of the outer shell.

9. The helmet of claim 8, wherein the drop-off runs continuously from the bottom left perimeter edge of the outer shell to the bottom right perimeter edge of the outer shell.

10. The helmet of claim 8, further comprising:

a visor magnetically coupled to a front of the helmet, opposite the rear end of the helmet, through at least one magnet coupled to the first surface.

11. The helmet of claim 10, wherein the visor terminates with two lateral edges that align, respectively, with left and right sides of the first surface at the drop-off.

12. The helmet of claim 8, further comprising at least three chines extending forward from the drop off along the first surface.

13. A helmet, comprising:

an outer shell having an outer surface and an inner surface, the outer surface comprising a first surface and a second surface, the first and second surfaces joined by a drop-off extending across the outer surface from adjacent a left bottom edge of the outer shell to adjacent a right bottom edge of the outer shell;

a coronal plane coplanar with a cross-section of the outer shell having an area enclosed within the outer surface of the outer shell, and perpendicular with a central longitudinal axis of the helmet;

an anterior section anterior to the coronal plane and a posterior section posterior to the coronal plane and comprising the entire drop-off and a rear end of the helmet distal to the anterior section;

an inner liner having an inner surface, and having an outer surface coupled to the inner surface of the outer shell;

wherein a majority of a length of the drop-off is closer to the coronal plane than to the rear end of the helmet; and wherein the first surface defines a top of the drop-off and the second surface defines a bottom of the drop-off, and wherein along the entire drop-off, the bottom of the drop-off is closer to the central longitudinal axis of the helmet than the top of the drop-off such that the drop-off has a height.

14. The helmet of claim 13, further comprising an occipital cliff located at the rear end of the helmet and approximately perpendicular to the second surface proximate the drop-off.

15. The helmet of claim 13, further comprising a plurality of vents comprising at least one intake vent in the anterior section of the helmet and at least one output vent in the posterior section of the helmet, the plurality of vents providing fluid communication between outside the helmet and inside the helmet.

16. The helmet of claim 15, wherein the at least one output vents comprises at least one inline vent having a pair of surfaces approximately parallel with the second surface of the outer shell proximate the inline vent, and at least one hidden vent located on an occipital cliff, the occipital cliff located at the rear end of the helmet and approximately perpendicular to the second surface proximate the drop-off.

17. The helmet of claim 16:

wherein the second surface comprises an exterior output channel for each of the at least one inline vents that starts at the inline vent and extends away from the drop-off; and wherein each exterior output channel is formed in the outer surface of the helmet.

18. The helmet of claim 15, wherein a combined incident surface area of all of the at least one output vents is greater than a combined incident surface area of all of the at least one intake vents.

19. The helmet of claim 13, further comprising at least three chines extending forward from the drop off along the first surface.

20. The helmet of claim 13, wherein the drop-off runs continuously from the left bottom left edge of the outer shell to the right bottom right edge of the outer shell.

* * * * *